US008074854B2

(12) United States Patent
Hu

(10) Patent No.: US 8,074,854 B2
(45) Date of Patent: Dec. 13, 2011

(54) SAFETY NAILING DEVICE

(75) Inventor: Chih-Wei Hu, Tali (TW)

(73) Assignee: Apex Mfg. Co., Ltd., Taichung Hsien (TW)

( * ) Notice: Subject to any disclaimer, the term of this patent is extended or adjusted under 35 U.S.C. 154(b) by 74 days.

(21) Appl. No.: 12/635,622

(22) Filed: Dec. 10, 2009

(65) Prior Publication Data

US 2011/0121047 A1 May 26, 2011

(30) Foreign Application Priority Data

Nov. 20, 2009 (TW) ..... 98139500 A

(51) Int. Cl.
*B27F 7/02* (2006.01)
*B27F 7/32* (2006.01)

(52) U.S. Cl. ..... 227/8; 227/130; 227/132

(58) Field of Classification Search ..... 227/8, 131, 227/130, 132, 146
See application file for complete search history.

(56) References Cited

U.S. PATENT DOCUMENTS 4,126,260 A * 11/1978 Mickelsson ..... 227/132
4,452,388 A * 6/1984 Fealey ..... 227/132
7,464,845 B2 * 12/2008 Chou ..... 227/132

* cited by examiner

*Primary Examiner* — Rinaldi Rada
*Assistant Examiner* — Nathaniel Chukwurah

(57) ABSTRACT

A safety nailing device of the present invention includes a main body, an actuator, a striking plate and a disengaging means. The main body defines a chamber therein, and an opening is defined on a bottom surface of the main body to communicate with the chamber. The actuator is disposed on the main body and has a controlling end. The striking plate is disposed in the chamber and is movable between a safety position, a starting position and a striking position. The striking plate has a protrusive end and a controlling groove. The protrusive end selectively protrudes out of the chamber from the opening, and the controlling groove is selectively engaged with the controlling end. The disengaging means is for moving the striking plate to the safety position to disengage the controlling end from the controlling groove, so that the travel of the actuator will not lift the striking plate.

5 Claims, 7 Drawing Sheets

SAFETY NAILING DEVICE

BACKGROUND OF THE INVENTION

1. Field of the Invention

The present invention relates to a nailing device, and more particularly to a nailing device with safety mechanisms to prevent the accidental percussion.

2. Description of the Prior Art

A nailing device is mainly used to strike a nail into an object, and commonly includes a main body, an actuator, a striking plate and a magazine. A user of the nailing device can presses the actuator to lift the striking plate, thereafter the striking plate can rebound quickly to strike one of the nails in the magazine.

To prevent the accidental percussion, some nailing devices are provided with safety mechanisms. As disclosed in U.S. Pat. No. 7,571,840, a rotatable retainer (25) is provided to stop the striker plate (13) from lifting, so as to further prohibit the percussion of the nailing device. Nevertheless, the handle (15) and the striker plate (13) are still in a motional operative relationship. However, some users do not understand the stop of the handle (15) is purposely designed to prevent the accidental percussion. On the contrary, they may consider that the handle is jammed because of rusted joints, thus they press the handle harder and harder until one of the handle, the retainer and the striker plate breaks.

Another safety mechanism is as disclosed in U.S. Pat. No. 3,948,426. '426 provides springs to push the blade (26) to extend out of the exit (38), such that the pawl surface (42) cannot engage the recess (44) on the hammer (25). This design substantially resolves the above-mentioned disadvantages, yet it arises new ones. For example, the elastic potential energy of the springs will percuss the blade (26) to extend out of the exit (38) rapidly, thus striking a nail into an object over-deeply as shown in FIG. 10. As a result, the object, such as paper, leather or cloth, will have defects such as dents or holes. Besides, the user of the nailing device have to overcome the elastic energy of the spring to push the blade (26) back into the exit (38), which would also leave dents on the object, as shown in FIG. 11. In addition, such nailing device is not adapted for the user to operate single-handedly and steadily in order to overcome the elastic energy while pressing the blade.

As such, the present invention is arisen to obviate or at least mitigate the above-mentioned disadvantages.

SUMMARY OF THE INVENTION

The main object of the present invention is to provide a safety nailing device whose actuator selectively disengages from a striking plate thereof.

To achieve the above and other objects, a nailing device of the present invention includes a main body, an actuator, a striking plate and a disengaging means. The main body defines a chamber therein, and an opening is defined on a bottom surface of the main body to communicate with the chamber. The actuator is disposed on the main body and has a controlling end. The striking plate is disposed in the chamber and is movable between a safety position, a starting position and a striking position. The striking plate has a protrusive end and a controlling groove. The protrusive end selectively protrudes out of the chamber from the opening, and the controlling groove is selectively engaged with the controlling end. The disengaging means is for moving the striking plate to the safety position to disengage the controlling end from the controlling groove, so that the travel of the actuator will not lift the striking plate.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
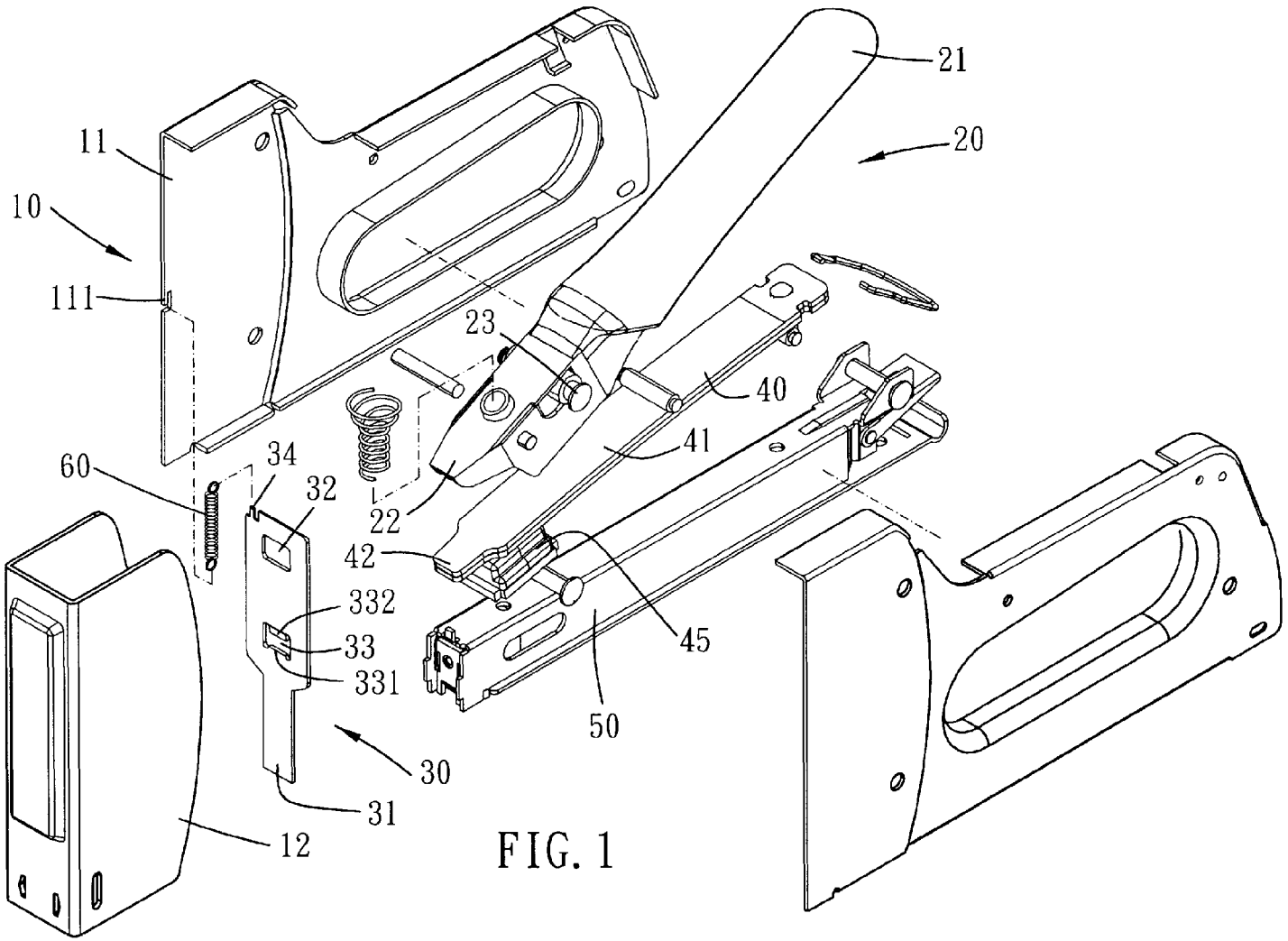
FIG. 1 is a breakdown drawing showing a nailing device of the present invention.
Figure 2:
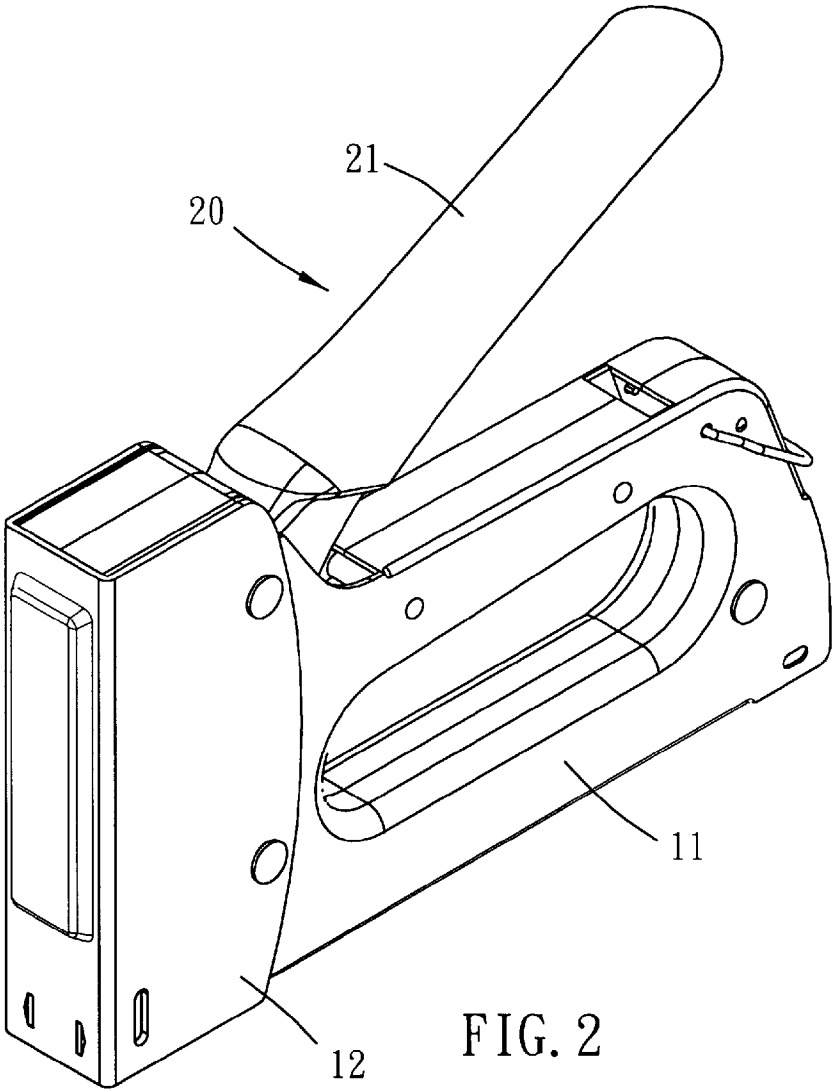
FIG. 2 is a combination drawing showing a nailing device of the present invention.

Please refer to FIG. 1 and FIG. 2 for a preferred embodiment of the present invention. A safety nailing device of the present embodiment includes a main body 10, an actuator 20, a striking plate 30, a leaf spring 40, a magazine 50 and a disengaging means.

The main body 10 substantially consists of two side plates 11 and a front plate 12, and defines a chamber between the side plates 11 and the front plate 12. An opening is defined on a bottom surface of the main body 10 to communicate the chamber with the surrounding.

The actuator 20 is pivotably disposed on the main body 10, and it has a pressing end 21 and a controlling end 22. The pressing end 21 is for a user of the nailing device to press, and the controlling end 22 is received in the chamber. In addition, the actuator 20 is provided with a pivot 23 disposed between the pressing end 21 and the controlling end 22. Further, the actuator 20 is slidable with respect to the pivot 23. In the present embodiment, the pressing end 21 and the controlling end 22 are integrally formed, yet they may also be separately formed and fit together thereafter.

The striking plate 30 is disposed in the chamber and is substantially linearly movable between a safety position, a starting position and a striking position. The striking plate 30 has a protrusive end 31, a controlling groove 32 and a connecting groove 33. The protrusive end 31 selectively protrudes out of the chamber from the opening. The controlling groove 32 is selectively engaged with and driven by the controlling end 22. The connecting groove 33 locates between the protrusive end 31 and the controlling groove 32 and has a first end 331 and a second end 332. A top of the striking plate 30 is further formed with a protrusion 34, yet the protrusion 34 can also be formed elsewhere suitable on the striking plate 30.

Figure 3:
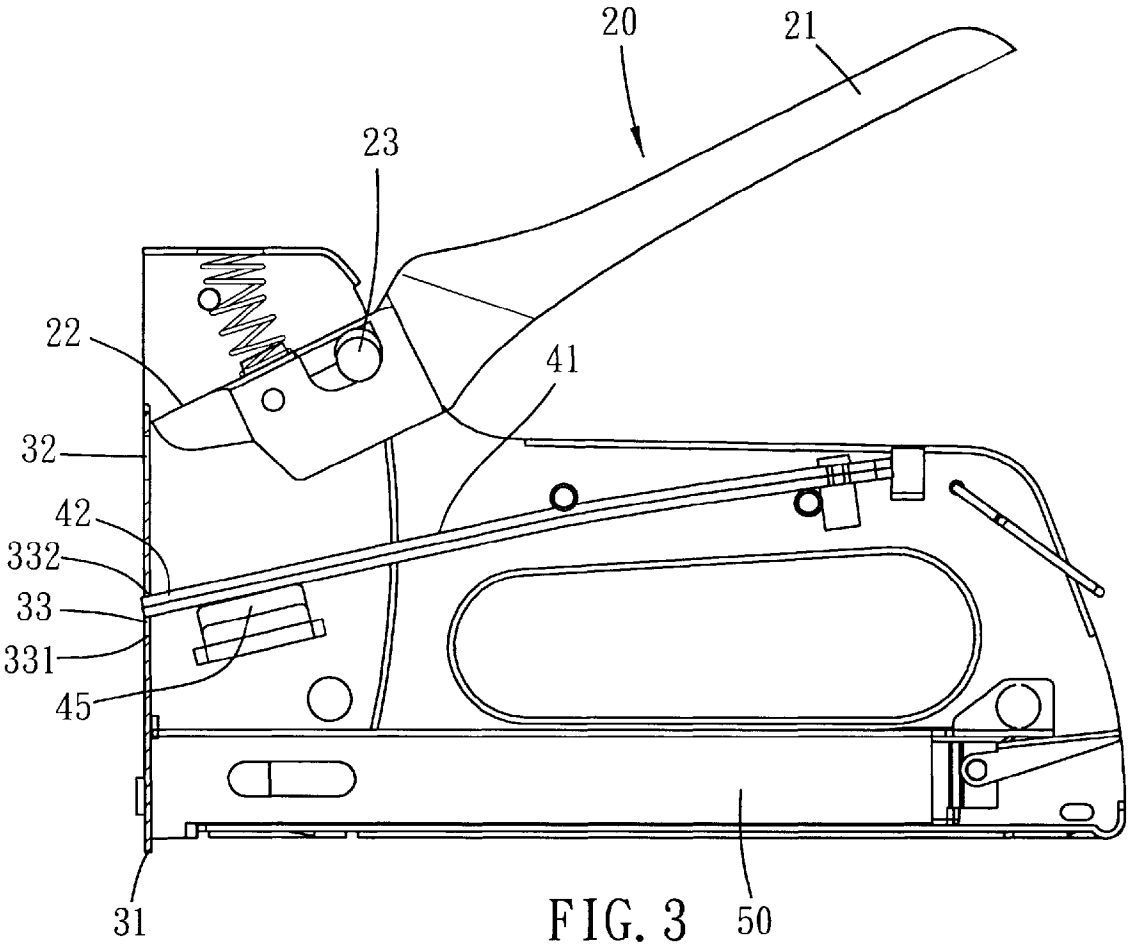
FIG. 3 is a lateral view showing a nailing device, with its striking plate at the safety position, of the present invention.
Figure 5:
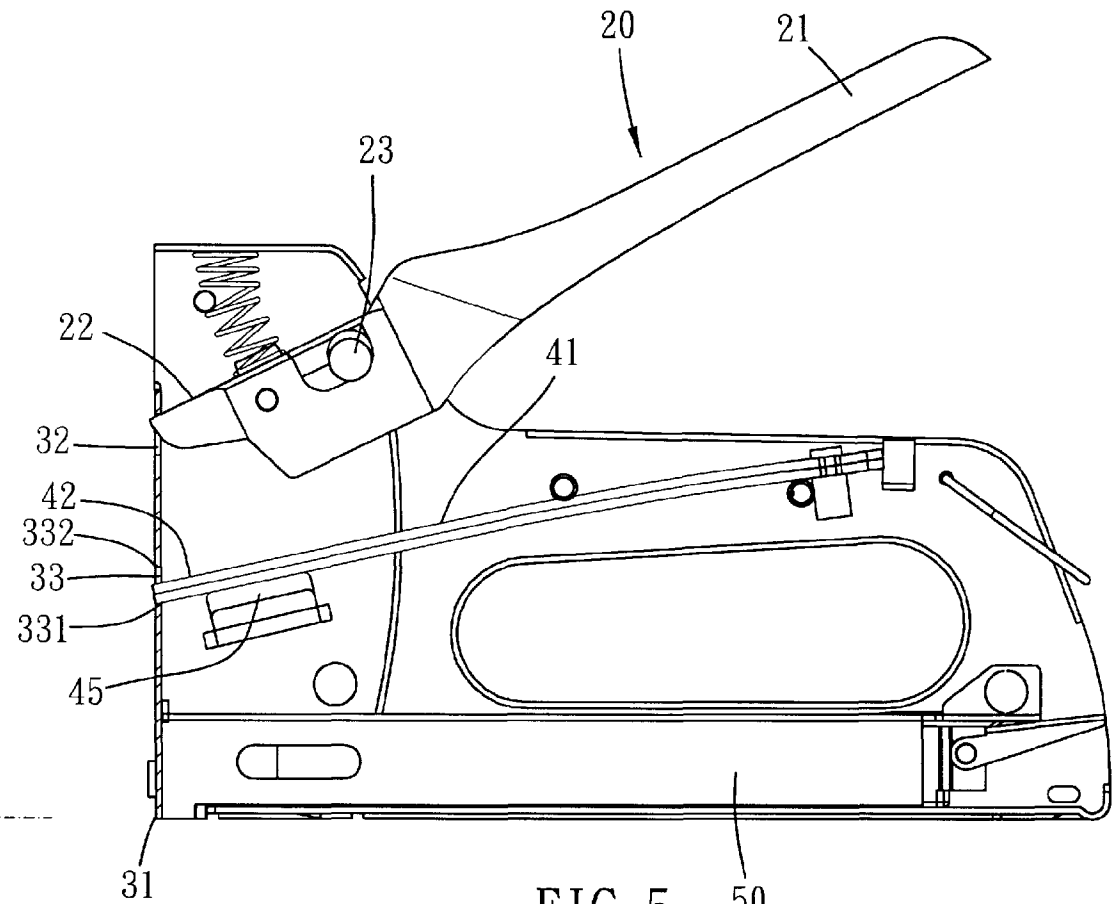
FIG. 5 is a lateral view showing a nailing device, with its striking plate at the starting position, of the present invention.
Figure 7:
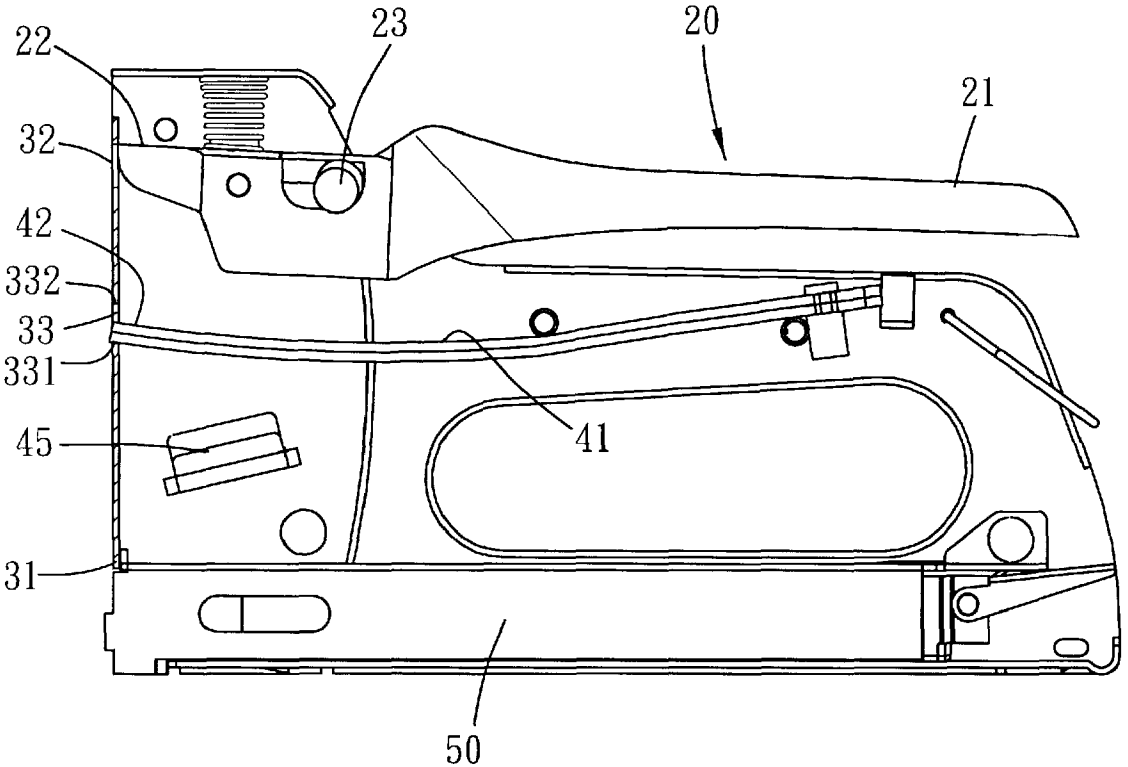
FIG. 7 is a lateral view showing a nailing device, with its striking plate at the striking position, of the present invention.

The leaf spring 40 is disposed in the chamber and has a working section 41. A thickness of a distal end 42 of the working section 41 is smaller than a length of the connecting groove 33 so that the distal end 42 is movably inserted into the connecting groove 33 between the first and second ends 331 and 332. More specifically, the distal end 42 abuts against the first end 331 as the striking plate 30 locates at the starting position (as shown in FIG. 5) or the striking position (as shown in FIG. 7), and the distal end 42 abuts against the second end 332 as the striking plate 30 locates at the safety position (as shown in FIG. 3). Preferably, the distal end 42 relatively slides along the connecting groove 33 (from the first end 331 toward the second end 332) while the striking plate 30 moves from the starting position to the safety position. As such, the elastic potential energy of the leaf spring 40 substantially remains unchanged. Moreover, the working section 41 is swayable between a bending position and a release position. When the working section 41 sways from the release position to the bending position, the elastic potential energy of the leaf spring 40 increases. Specifically, when the striking plate 30 locates at the striking position (as shown in FIG. 7), the working section 41 locates at the bending position. And when the striking plate 30 locates at either the starting position (as shown in FIG. 5) or the safety position (as shown in FIG. 3), the working section 41 locates at the release position. The nailing device may further include a cushion pad 45 for the leaf spring 40 to rest thereon. More specifically, the cushion pad 45 is disposed to cushion the impact of the leaf spring 40 while the leaf spring 40 is releasing its elastic potential energy. As such, the swaying travel of the working section 41 is limited, preventing the protrusive end 31 from being driven out of the opening vigorously. Thus nails in the magazine 50 will not be nailed over-deeply in an object.

The magazine 50 is disposed in the chamber for holding the nails, which are sequentially stricken out from the opening by the striking plate 30. The nails may be U-shaped, T-shaped, I-shaped or any other shape suitable.

In the present embodiment, the disengaging means includes a resilient member 60. One end of the resilient member 60 is disposed on the striking plate 30, and more particularly on the protrusion 34. Another end of the resilient member 60 is disposed on the body 10, e.g. on a protrusion 111 formed on one of the side plates 11. Thereby, the striking plate 30 can be urged to the safety position. Preferably, a Hooke's constant of the resilient member 60 is considerably smaller than that of the leaf spring 40. As such, a smaller amount of the elastic potential energy of the resilient member 60 is all the user needs to overcome to move the striking plate 30 from the safety position to the starting position. Therefore, no obvious dent will be left on the object, such as paper, leather or cloth due to the press of the protrusive end 31.

In other embodiments of the present invention, the disengaging means may include a switch and a transmission mechanism. The switch is disposed anywhere suitable on the nailing device for the user to press, to turn or to twist, and the transmission mechanism is disposed between the switch and the striking plate. The transmission mechanism may include linkages, gear sets and/or springs so as to be driven by the switch to selectively move the striking plate 30 between the safety position and the starting position.

The operation of the nailing device of the present invention is disclosed hereinafter.

Figure 4:
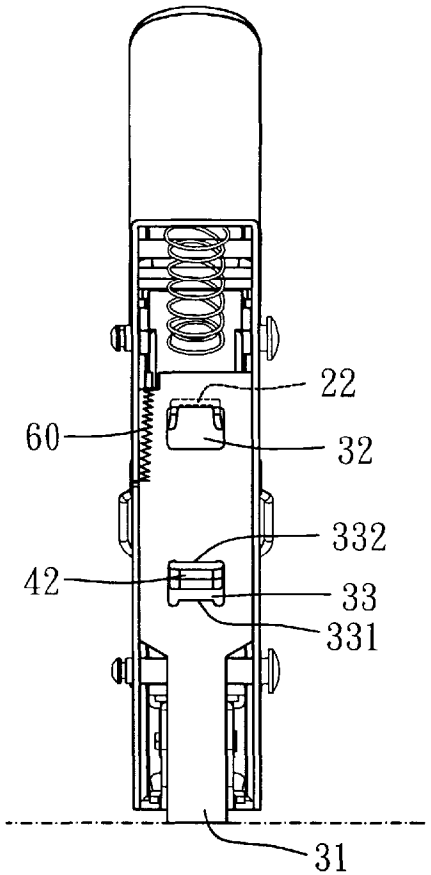
FIG. 4 is a profile showing a nailing device, with its striking plate at the safety position, of the present invention.

As shown in FIG. 3 and FIG. 4, the striking plate 30 locates at the safety position. In this case, the protrusive end 31 protrudes out of the opening. Because the striking plate 30 moves to a lower position, the controlling end 22 cannot engage with the controlling groove 32, i.e. the pivoting travel of the actuator 20 cannot drive the striking plate 30 to move. In other words, the striking plate 30 remains motionless even when the actuator 20 is pressed by the user since the controlling end 22 and the controlling groove 32 are in a non-engagement relationship. As such, the accidental percussion is prohibited, and the parts of the nailing device will not be broken even when the actuator is vigorously pressed.

Figure 6:
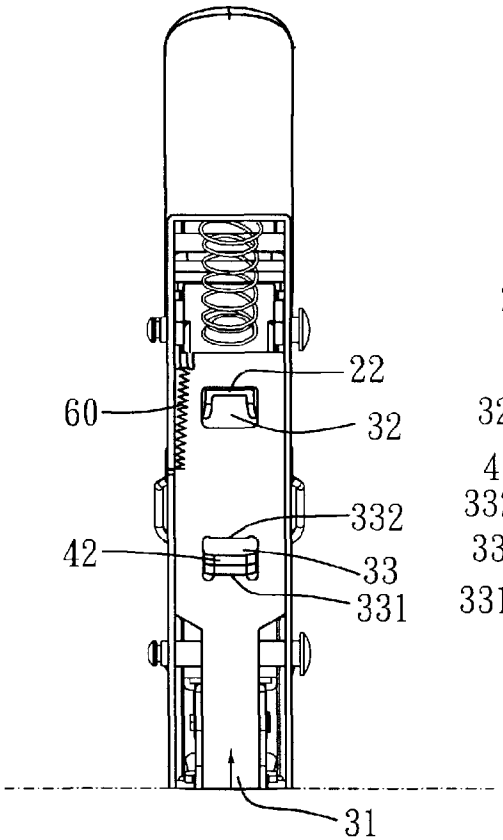
FIG. 6 is a profile showing a nailing device, with its striking plate at the starting position, of the present invention.

As shown in FIG. 5 and FIG. 6, the protrusive end 31 is abutted against to overcome the elastic potential energy of the resilient member 60 and sinks into the chamber. That is, the striking plate 30 is pushed to the starting position, allowing the controlling end 22 to engage with the controlling groove 32 in a motional operative relationship. As such, the pivoting travel of the actuator 20 can drive the striking plate 30 to move.

Figure 8:
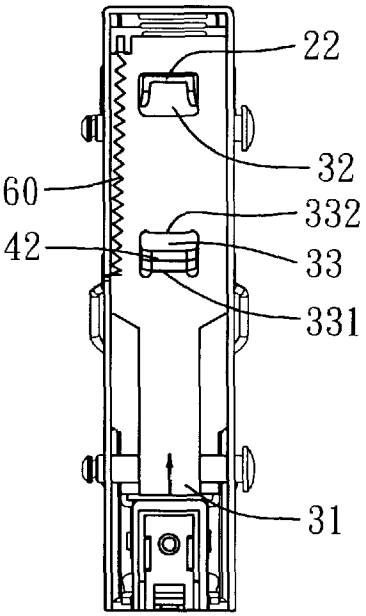
FIG. 8 is a profile showing a nailing device, with its striking plate at the striking position, of the present invention.
Figure 9:
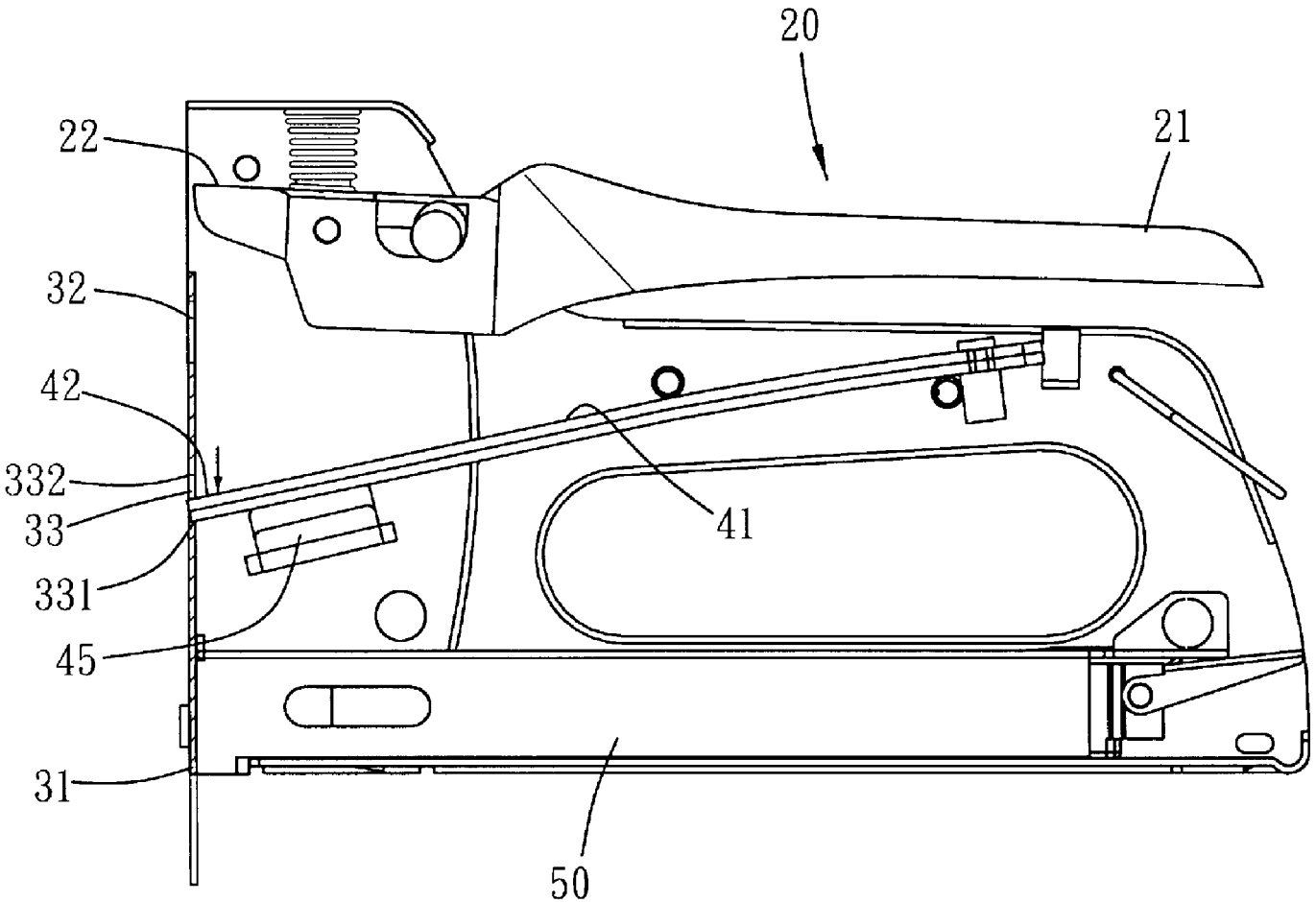
FIG. 9 is a lateral view showing a nailing device, with its striking plate rebounding from the striking position to the starting position, of the present invention.
Figure 11:
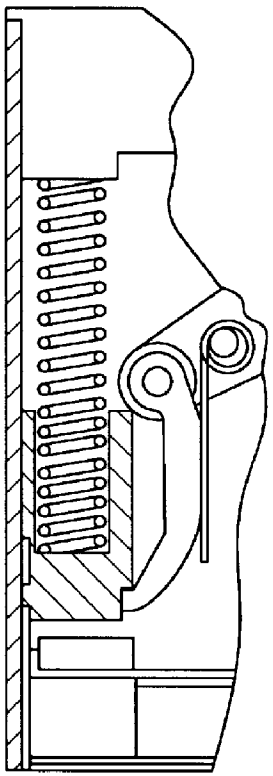
FIG. 11 PRIOR ART
FIG. 11 is a profile showing a nailing device of the prior art.
Figure 10:
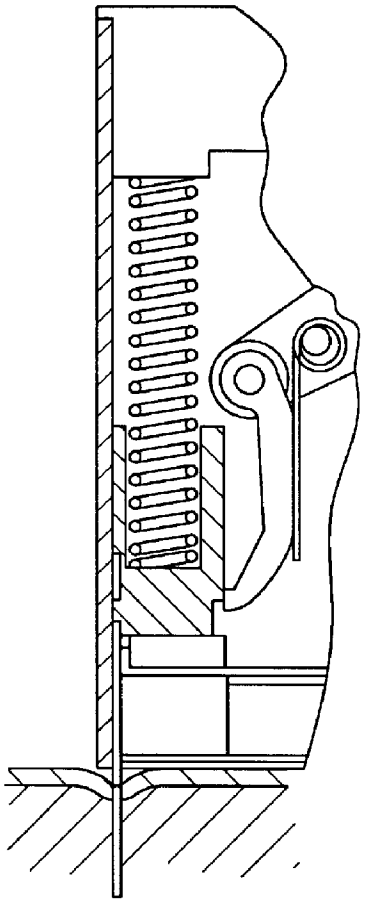
FIG. 10 PRIOR ART
FIG. 10 is a profile showing a nailing device of the prior art.

As shown in FIG. 7 and FIG. 8, the striking plate 30 is driven by the actuator 20 to move from the starting position to the striking position as the user presses the pressing end 21. The elastic potential energy of the leaf spring 40 is thereby increased. Once the striking plate 30 is moved to the striking position, the controlling end 22 disengages from the controlling groove 32. As a result, the elastic potential energy of the leaf spring 40 releases quickly to bring the striking plate 30 back to the starting position, striking one of the nail into the object, as shown in FIG. 9. Because the travel of the working section 41 is limited by the cushion pad 45, the protrusive end 31 halts just as it flushes with the opening. As such, the nail will not be nailed over-deeply into the object to cause dents or holes on the object.

In summarization, the nailing device of the present invention can prohibit the accidental percussion of nails and prevent the parts from breaking. Furthermore, the distal end of the working section is slidable with respect to the connecting groove of the striking plate, thus the leaf spring itself will not push the striking plate toward the safety position. As such, the protrusive end of the striking plate will not leave noticeable dents on the object while abutting against the object.

What is claimed is:

1. A nailing device, comprising:

a main body, defining a chamber therein, an opening being defined on a bottom surface of the main body to communicate with the chamber;

an actuator, pivotably disposed on the main body, the actuator having a pressing end and a controlling end, the controlling end being received in the chamber;

a striking plate, disposed in the chamber, the striking plate being movable between a safety position, a starting position and a striking position, the striking plate having a protrusive end, a controlling groove and a connecting groove, the protrusive end selectively protruding out of the chamber from the opening, the controlling groove being selectively engaged with the controlling end, the connecting groove having a first end and a second end;

a leaf spring, disposed in the chamber, the leaf spring having a working section, a thickness of a distal end of the working section being smaller than a length of the connecting groove, whereby the distal end of the working section is movably inserted into the connecting groove between the first and second ends; and a disengaging means for moving the striking plate to the safety position;

wherein, when the striking plate locates at the safety position, the protrusive end protrudes out of the chamber from the opening, the controlling end disengages from the controlling groove, and a travel of the actuator does not drive the striking plate to lift;

wherein, when the protrusive end is pressed against to sink into the chamber, the striking plate locates at the starting position, and the controlling end engages with the controlling groove, the travel of the actuator drives the striking plate to lift from the starting position to the striking position, and an elastic potential energy of the leaf spring increases as well;

wherein, when the striking plate locates at the striking position, the controlling end disengages from the controlling groove, the elastic potential energy of the leaf spring quickly releases to move the striking plate back to the starting position rapidly;

wherein, when the striking plate locates at the starting position or the striking position, the distal end of the working section abuts against the first end of the connecting groove; when the striking plate locates at the safety position, the distal end of the working section abuts against the second end of the connecting groove;

wherein, when the striking plate moves from the starting position to the safety position, the distal end of the working section relatively slides along the connecting groove, and the elastic potential energy of the leaf spring substantially remains unchanged.

2. The nailing device of claim 1, wherein the working section is swayable between a bending position and a release position, when the working section sways from the release position to the bending position, the elastic potential energy of the leaf spring increases;

wherein, when the striking plate locates at the striking position, the working section locates at the bending position;

wherein, when the striking plate locates at the starting position or the safety position, the working section locates at the release position.

3. The nailing device of claim 1, further comprising a magazine disposed in the chamber for receiving nails, the nails being adapted to be stricken out from the opening by the striking plate sequentially.

4. The nailing device of claim 1, further comprising a cushion pad for the leaf spring to rest thereon.

5. The nailing device of claim 1, wherein the disengaging means comprises a resilient member, one end of the resilient member being disposed on the striking plate, another end thereof being disposed on the main body, a Hooke's constant of the resilient member being considerably smaller than that of the leaf spring.

* * * * *